US008215083B2

(12) United States Patent
Toas et al.

(10) Patent No.: US 8,215,083 B2
(45) Date of Patent: Jul. 10, 2012

(54) INSULATION BOARD WITH AIR/RAIN BARRIER COVERING AND WATER-REPELLENT COVERING

(75) Inventors: Murray S. Toas, Norristown, PA (US); Stephen O. Barefoot, Charlotte, NC (US); Michael J. Lembo, Souderton, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 12/498,041

(22) Filed: Jul. 6, 2009

(65) Prior Publication Data

US 2009/0266025 A1 Oct. 29, 2009

Related U.S. Application Data

(62) Division of application No. 10/898,740, filed on Jul. 26, 2004, now abandoned.

(51) Int. Cl.

| | |
|---|---|
| ***E04B 1/00*** | (2006.01) |
| ***E04B 1/74*** | (2006.01) |
| ***E04B 2/00*** | (2006.01) |
| ***E04C 2/34*** | (2006.01) |
| ***B29D 22/00*** | (2006.01) |
| ***B32B 3/02*** | (2006.01) |
| ***B32B 3/00*** | (2006.01) |
| ***B41M 5/00*** | (2006.01) |

(52) U.S. Cl. ..... 52/748.1; 52/169.11; 52/407.4; 52/407.5; 52/406.1; 52/506.01; 52/794.1; 428/36.91; 428/70; 428/71; 428/195.1

(58) Field of Classification Search ..... 428/36.91, 428/70, 71, 195.1; 52/95, 169.11, 407.4, 52/407.5, 404.1–404.3, 406.1–406.3, 506.01, 52/794.1

See application file for complete search history.

(56) References Cited

U.S. PATENT DOCUMENTS 2,341,130 A 2/1944 Unsworth (Continued)

FOREIGN PATENT DOCUMENTS

DE 3546968 3/2002

(Continued)

OTHER PUBLICATIONS

Aircon, "Ventilation, Extraction and Air Conditioning—Installation Materials", Nov. 1991.

(Continued)

*Primary Examiner* — Brian Glessner
*Assistant Examiner* — Omar Hijaz
(74) *Attorney, Agent, or Firm* — Duane Morris LLP; Steven E. Koffs

(57) ABSTRACT

A previously formed unitary building exterior envelope product is provided, comprising: a mineral fiber insulation board including a binder having a hydrophobic agent and is resistant to liquid water-penetration and has first and second major surfaces, an exterior facing material, which resists air infiltration and liquid water penetration, laminated to the first major surface, the exterior facing material being permeable to water vapor, and a continuous interior facing laminated to the second major surface, so that the second major surface is resistant to liquid water-penetration and is permeable to water vapor. The section of product is mounted to an exterior side of a plurality of framing members of an exterior wall of a building, so that the interior facing faces the framing members. An exterior layer is mounted to the framing members using a connection device that passes through the section of product, with the facing material facing the exterior layer.

17 Claims, 8 Drawing Sheets

U.S. PATENT DOCUMENTS

| | | | | |
|---|---|---|---|---|
| 2,428,591 | A | | 10/1947 | Slayter |
| 2,467,291 | A | | 4/1949 | Brelsford et al. |
| 2,619,151 | A | | 11/1952 | Sheidley |
| 2,647,857 | A | | 8/1953 | Horn |
| 2,695,855 | A | | 11/1954 | Stephens |
| 2,768,026 | A | | 10/1956 | Stephens et al. |
| 2,790,464 | A | | 4/1957 | Stephens et al. |
| 2,825,389 | A | | 3/1958 | Stephens |
| 2,881,110 | A | | 4/1959 | Walker et al. |
| 2,938,737 | A | | 5/1960 | Walker et al. |
| 3,002,857 | A | | 10/1961 | Stalego |
| 3,025,197 | A | | 3/1962 | Sheidley |
| 3,092,529 | A | | 6/1963 | Pearson |
| 3,093,037 | A | | 6/1963 | Ward, Jr. |
| 3,113,788 | A | | 12/1963 | Johnston |
| 3,212,529 | A | | 10/1965 | Ullman et al. |
| 3,242,527 | A | | 3/1966 | Rosenberg |
| 3,265,530 | A | | 8/1966 | Marzocchi et al. |
| 3,325,340 | A | | 6/1967 | Walker et al. |
| 3,394,737 | A | | 7/1968 | Hoffmann et al. |
| 3,396,070 | A | | 8/1968 | Gambill et al. |
| 3,420,142 | A | | 1/1969 | Gale et al. |
| 3,492,771 | A | | 2/1970 | Jones et al. |
| 3,507,730 | A | | 4/1970 | Gambill et al. |
| 3,557,840 | A | | 1/1971 | Maybee |
| 3,605,534 | A | | 9/1971 | Barr |
| 3,615,969 | A | | 10/1971 | Hegg |
| 3,616,181 | A | | 10/1971 | Stalego |
| 3,642,554 | A | | 2/1972 | Hensley |
| 3,642,560 | A | | 2/1972 | Marsh, Jr. et al. |
| 3,768,523 | A | | 10/1973 | Schroeder |
| 3,861,425 | A | | 1/1975 | Clark |
| 3,867,221 | A | | 2/1975 | Chant |
| 3,885,593 | A | | 5/1975 | Koerber et al. |
| 3,908,062 | A | * | 9/1975 | Roberts ..... 442/320 |
| 3,915,783 | A | | 10/1975 | Goppel et al. |
| 3,942,774 | A | | 3/1976 | Sokolow |
| 3,945,962 | A | | 3/1976 | Clark |
| 3,980,511 | A | | 9/1976 | Proucelle |
| 3,996,824 | A | | 12/1976 | Cailey |
| 4,002,367 | A | | 1/1977 | Thomas |
| 4,005,234 | A | | 1/1977 | Stroupe |
| 4,067,678 | A | | 1/1978 | Beranek, Jr. et al. |
| 4,070,954 | A | | 1/1978 | Cailey |
| 4,101,700 | A | | 7/1978 | Ray et al. |
| 4,175,159 | A | | 11/1979 | Raleigh |
| 3,549,473 | A | | 12/1979 | LeBlanc et al. |
| 4,179,808 | A | | 12/1979 | Smith |
| 4,183,379 | A | | 1/1980 | Marquette et al. |
| 4,196,755 | A | | 4/1980 | Kutnyak et al. |
| 4,212,920 | A | | 7/1980 | Seamans |
| 4,226,662 | A | | 10/1980 | McCort |
| 4,243,075 | A | | 1/1981 | McPherson et al. |
| 4,265,963 | A | | 5/1981 | Matalon |
| 4,278,468 | A | | 7/1981 | Selbe et al. |
| 4,288,964 | A | | 9/1981 | Petersen |
| 4,304,267 | A | | 12/1981 | Campbell, Jr. |
| 4,310,585 | A | * | 1/1982 | Shannon ..... 428/218 |
| 4,346,543 | A | | 8/1982 | Wilson et al. |
| 4,389,587 | A | | 6/1983 | Levine et al. |
| 4,421,815 | A | | 12/1983 | Briggs et al. |
| 4,443,520 | A | | 4/1984 | Braithwaite, Jr. |
| 4,456,637 | A | | 6/1984 | Takeda et al. |
| 4,472,478 | A | | 9/1984 | Briggs et al. |
| 4,490,927 | A | | 1/1985 | Kissell |
| 4,528,053 | A | | 7/1985 | Auer |
| 4,544,409 | A | | 10/1985 | Daussan et al. |
| 4,573,715 | A | | 3/1986 | Ambruster |
| 4,575,981 | A | * | 3/1986 | Porter ..... 52/309.9 |
| 4,621,013 | A | | 11/1986 | Holtrop et al. |
| 4,680,070 | A | | 7/1987 | Hughes |
| 4,709,523 | A | * | 12/1987 | Broderick et al. ..... 52/506.05 |
| 4,758,395 | A | | 7/1988 | Zion |
| 4,824,714 | A | | 4/1989 | Gest |
| 4,839,222 | A | | 6/1989 | Jain |
| 4,887,663 | A | | 12/1989 | Auxier et al. |
| 4,888,233 | A | | 12/1989 | Brew |
| 4,895,745 | A | | 1/1990 | Vesley et al. |
| 4,904,510 | A | | 2/1990 | Nath et al. |
| 4,906,504 | A | | 3/1990 | Skjold Petersen et al. |
| 4,909,282 | A | | 3/1990 | Staugaard |
| 4,968,556 | A | | 11/1990 | Jain |
| 4,969,302 | A | * | 11/1990 | Coggan et al. ..... 52/309.8 |
| 4,983,081 | A | | 1/1991 | Cunningham, Jr. |
| 4,990,370 | A | | 2/1991 | Terry et al. |
| 5,008,131 | A | | 4/1991 | Bakhshi |
| 5,009,932 | A | | 4/1991 | Klett et al. |
| 5,020,481 | A | | 6/1991 | Nelson |
| 5,025,052 | A | | 6/1991 | Crater et al. |
| 5,035,951 | A | | 7/1991 | Dimanshteyn |
| RE34,020 | E | | 8/1992 | Briggs et al. |
| 5,144,795 | A | | 9/1992 | Field |
| 5,169,700 | A | | 12/1992 | Meier et al. |
| 5,186,704 | A | | 2/1993 | Cunningham, Jr. |
| 5,192,598 | A | * | 3/1993 | Forte et al. ..... 428/71 |
| 5,300,592 | A | | 4/1994 | Kanagawa et al. |
| 5,310,594 | A | | 5/1994 | Holland et al. |
| 5,314,719 | A | | 5/1994 | Batdorf et al. |
| 5,330,691 | A | | 7/1994 | Geereart |
| 5,370,919 | A | | 12/1994 | Fieuws et al. |
| 5,371,989 | A | | 12/1994 | Lehnert et al. |
| 5,379,806 | A | | 1/1995 | Matthews et al. |
| 5,384,188 | A | | 1/1995 | Lebold et al. |
| 5,385,610 | A | | 1/1995 | Deerer et al. |
| 5,391,840 | A | | 2/1995 | Hughes et al. |
| 5,397,631 | A | | 3/1995 | Green et al. |
| 5,421,938 | A | | 6/1995 | Cunningham, Jr. |
| 5,426,905 | A | | 6/1995 | Rollhauser et al. |
| 5,452,551 | A | | 9/1995 | Charland et al. |
| 5,460,206 | A | | 10/1995 | Sansoucy |
| 5,487,412 | A | | 1/1996 | Matthews et al. |
| 5,528,904 | A | | 6/1996 | Jones et al. |
| 5,534,298 | A | | 7/1996 | Cross et al. |
| 5,534,573 | A | | 7/1996 | Leake |
| 5,549,942 | A | | 8/1996 | Watts |
| 5,567,504 | A | | 10/1996 | Schakel et al. |
| 5,578,258 | A | | 11/1996 | Grant et al. |
| 5,612,405 | A | | 3/1997 | Bainbridge et al. |
| 5,624,471 | A | | 4/1997 | Gaeta et al. |
| 5,625,999 | A | * | 5/1997 | Buzza et al. ..... 52/793.11 |
| 5,631,097 | A | * | 5/1997 | Andersen et al. ..... 428/703 |
| 5,712,012 | A | | 1/1998 | Forman et al. |
| 5,750,225 | A | | 5/1998 | Petty |
| 5,762,109 | A | | 6/1998 | Matthews et al. |
| 5,765,586 | A | | 6/1998 | Facas et al. |
| 5,766,681 | A | | 6/1998 | Stoddart et al. |
| 5,776,841 | A | | 7/1998 | Bondoc et al. |
| 5,783,268 | A | | 7/1998 | Noonan et al. |
| 5,783,623 | A | | 7/1998 | Skoufis et al. |
| 5,836,357 | A | | 11/1998 | Kittson et al. |
| 5,837,621 | A | | 11/1998 | Kajander |
| 5,925,457 | A | | 7/1999 | McGinniss et al. |
| 5,953,818 | A | | 9/1999 | Matthews et al. |
| 5,958,137 | A | | 9/1999 | Caldwell et al. |
| 5,968,669 | A | | 10/1999 | Liu et al. |
| 5,985,429 | A | | 11/1999 | Plummer et al. |
| 6,000,437 | A | | 12/1999 | Ponder et al. |
| 6,148,867 | A | | 11/2000 | Matthews et al. |
| 6,207,245 | B1 | | 3/2001 | Miller et al. |
| 6,213,522 | B1 | | 4/2001 | Jacobson et al. |
| 6,231,927 | B1 | | 5/2001 | Ruid |
| 6,270,865 | B1 | | 8/2001 | Noonan et al. |
| 6,331,350 | B1 | | 12/2001 | Taylor et al. |
| 6,451,432 | B1 | | 9/2002 | Azzopardi et al. |
| 6,457,237 | B1 | | 10/2002 | Matthews et al. |
| 6,555,951 | B2 | | 4/2003 | Jeoung |
| 6,769,455 | B2 | | 8/2004 | Toas et al. |
| 6,831,118 | B2 | | 12/2004 | Munzenberger |
| 6,935,379 | B1 | | 8/2005 | Buchanan, Sr. |
| 7,223,455 | B2 | * | 5/2007 | Ruid et al. ..... 428/36.91 |
| 7,364,015 | B2 | | 4/2008 | Englert et al. |
| 2001/0033782 | A1 | | 10/2001 | Conley |
| 2001/0033926 | A1 | | 10/2001 | Matthews et al. |
| 2001/0046456 | A1 | | 11/2001 | Langer et al. |
| 2002/0127399 | A1 | | 9/2002 | Mankell et al. |
| 2002/0139429 | A1 | | 10/2002 | Toas et al. |
| 2002/0146521 | A1 | | 10/2002 | Toas et al. |

| | | | | |
|---|---|---|---|---|
| 2003/0008092 | A1 | 1/2003 | Toas et al. | |
| 2003/0032351 | A1 | 2/2003 | Horner, Jr. et al. | |
| 2003/0056229 | A1 | 3/2003 | Crabtree et al. | |
| 2003/0068943 | A1 | 4/2003 | Fay | |
| 2003/0211795 | A1* | 11/2003 | Ruid et al. | 442/136 |
| 2003/0236043 | A1 | 12/2003 | Calzavara et al. | |
| 2004/0038608 | A1 | 2/2004 | Shaw et al. | |
| 2004/0050004 | A1* | 3/2004 | McCann | 52/404.2 |
| 2004/0118472 | A1 | 6/2004 | Mota et al. | |
| 2004/0118506 | A1 | 6/2004 | Dong | |
| 2004/0121152 | A1 | 6/2004 | Toas | |
| 2004/0137181 | A1 | 7/2004 | Ruid et al. | |
| 2005/0031819 | A1 | 2/2005 | Mankell et al. | |
| 2005/0229518 | A1* | 10/2005 | Ruid et al. | 52/404.1 |
| 2007/0004306 | A1* | 1/2007 | Leeser et al. | 442/394 |

FOREIGN PATENT DOCUMENTS

| | | | |
|---|---|---|---|
| EP | 0122905 | | 10/1984 |
| EP | 0581025 | | 2/1994 |
| EP | 0763690 | A2 | 3/1997 |
| ES | 219402661 | | 12/1994 |
| FR | 1137652 | | 6/1957 |
| GB | 2154257 | | 9/1985 |
| WO | WO 99/00338 | | 1/1999 |

OTHER PUBLICATIONS

CertainTeed—CertaPro™ (FiberGlass Insulation), Commercial Insulation, © 2003 CertainTeed Corporation.

CertainTeed—Product—Certapro™ Commercial Board, http://www.certainteed.com/pro/insulation/html/Commercial/ins_com_combrd.htm, Aug. 21, 2003.

CertainTeed, "List Prices—*ToughGard*™ Duct Board", Oct. 1, 1994, Valley Forge, Pennsylvania, USA.

CertainTeed—Comercial Board Insulation, http://www.allinterior.com/showrooms/certainteed/scenery/commercialboardinsulation.htm, visited Aug. 21, 2003.

CertainTeed, Product Index "Commercial Insulation,"http://www.certainteed.com/CertainTeed/Undefined/Insulation/Prodindex/Commercial, visited May 25, 2004.

CertainTeed, "Product Index" Mechanical/HVAC Insulation, http://www.certainteed.com/CertainTeed/Undefined/Insulation/Prodindex/Mechanical, visited Jun. 21, 2004.

CertainTeed, "Product Index" Residential Insulation, http://www.certainteed.com/CertainTeed/Undefined/Insulation/Proindex/Residental, visited May 25, 2004.

CertainTeed, "CertainTeed Product Information," CertainTeed Building Solutions, no later than Dec. 30, 2002.

CertainTeed Corporation, "Product Sheet—ToughGard Duct Board Fiber Glass Duct Board Systems," 1994, Valley Forge, Pennsylvania USA.

CertainTeed, "Product Specification: PS. 57.00", May 23, 1994, 9 pp.

CertainTeed, Product Sheet—ToughGard™ Duct Board with Enhanced Surface, http://www.certainteed.com/pro/insulation/html_AHprod/ins_mech_tgdb.html, visited Jul. 31, 2003.

CertainTeed Insulation Group, "Raw Material Specification: Certa*Faced Ultra*Duct Mat Facing", Jun. 23, 1994.

CertainTeed Specification Sheet—Acousta Blanket™ Black Insulation, May 2003.

CertainTeed Specification Sheet—AcoustaBoard™ Black Insulation, May 2003.

CertainTeed Specification Sheet—CertaPro™ AcoustaBoard™ Black, Oct. 2002.

CertainTeed Specification Sheet—CertaPro™ AcoustaBlanket Black™, Oct. 2002.

CertainTeed Specification Sheet—CertaPro™ AcoustaTherm™ Batts, May 2001.

CertainTeed Specification Sheet—CertaPro™ Commercial Board, May 2001.

CertainTeed Specification Sheet—CertaPro™ Partition Batts, Jun. 2002.

CertainTeed Specification Sheet—CertaPro™ Thermal Extended Flange Batts, Oct. 2002.

CertainTeed Specification Sheet—CertaPro™ Thermal Foil Faced Batts, Oct. 2003.

CertainTeed Specification Sheet—CertaPro™ Thermal FSK-25 Faced Batts, Jun. 2003.

CertainTeed Specification Sheet—CertaPro™ Thermal Kraft Faced Batts, Oct. 2002.

CertainTeed Specification Sheet—Basement Wall and Masonry Wall Fiber Glass Building Insulation, Apr. 2004.

CertainTeed Specification Sheet—Commercial Blanket Insulation, Apr. 2000.

CertainTeed Specification Sheet CrimpWrap™ Crimped Pipe and Tank Wrap, Dec. 2002.

CertainTeed Specification Sheet, EZR™ Fiber Glass Building Insulation, Jan. 2004.

CertainTeed Specification Sheet, Fiber Glass Building Insulation, Apr. 2004.

CertainTeed Specification Sheet, FlameChek™ Duct Insulation, Apr. 2002.

CertainTeed Specification Sheet, FlameChek™ Plenum Insulation, Nov. 2002.

CertainTeed Specification Sheet, FlameChek™ Plus 2 Duct Insulation (Single Layer System), Apr. 2002.

CertainTeed Specification Sheet—Metal Building Insulation 202-96, Jun. 2003.

CertainTeed Specification Sheet—OEM Acoustical Board Insulation, Mar. 2002.

CertainTeed Specification Sheet—Preformed Pipe Insulation, Aug. 2003.

CertainTeed Specification Sheet, Soft Touch™ Duct Wrap Insulation, Aug. 2003.

CertainTeed Specification Sheet—Sound Attenuation Batts Acoustical Ceiling Batts NoiseReducer™ Batts, Nov. 2003.

CertainTeed Specification Sheet—SpeedyR™ Tabless Batts, Sep. 2003.

CertainTeed, "Specification Sheet—ToughGard™ Duct Board", Apr. 2002.

CertainTeed Corporation, "Specification Sheet—ToughGard™ Duct Board with Enhanced Surface", Jan. 2002.

CertainTeed Corporation, "Specification Sheet ToughGard™ Duct Liner with Enhanced Surface", May 2001.

CertainTeed, Specification Sheet—ToughGard™ R Duct Liner with Enhanced Surface, Apr. 2004.

CertainTeed, Specification Sheet—ToughGard Rigid Liner Board with Enhanced Surface, Mar. 2002.

CertainTeed Corporation, Specification Sheet—Ultra*Duct™ Duct Board, Apr. 2001 or Mar. 2002.

CertainTeed Corporation, "Specification Sheet—Ultra*Duct™ Gold", Aug. 2003.

CertainTeed Specification Sheet—Ultralite® Duct Liner, Apr. 2003.

CertainTeed Specification Sheet—Universal Blanket, Aug. 2003.

CertainTeed ToughGard™ Duct Board, http://www.certainteed.com/cinsulate/cict00801p.html, visited Sep. 4, 2003.

CertainTeed, ToughGard™ Duct Board Fiber Glass Duct Board Systems.

CETIAT "Test Report" Jul. 24, 1991, 3 pages (translation attached).

Fiber-Glass Duct Systems, http://www.tpub.com/steelworker2/27.htm, visited Aug. 14, 2003.

France—Air, "Glass Fibre panels for air ducts" (translation attached), 21 pages (1992).

French Republic, National Testing Laboratory, Nov. 28, 1998, 1 page (translation attached).

IBACOS, Fibrous Glass Duct Board White Paper, 2003.

Isover Gullfiber—translation of the relevant parts of the Danish ventilation duct product "Industriplad Sort" and the corresponding Ventilation Duct Application brochure.

Isover Roclaine, "Recommended Prices Jan. 1990," Cristaleria Espanola S.A., Insulation Division, Jan. 1993, 3 pages (translation attached).

Isover Roclaine, "Recommended Prices Jan. 1991," Cristaleria Espanola S.A., Insulation Division, Jan. 1993, 3 pages (translation attached).

Johns-Manville, "Super Duct™" Air Duct Board Fabrication Instructions, AHS-204, Feb. 1998.

Johns Manville, Fiber Glass Mat (Acrylic Binder), Material Safety Data, Sheet ID: 1014, Section 1—Chemical Product and Company Identification pp. 1-6, Oct. 21, 2002.
Johns-Manville Fiber Glass, "Micro-Aire Duct Systems Fabrication Manual", USA (Jun. 1970).
Johns-Manville Manufacturing, "Finished Product Specification—Mat Faced Mad Board Spec No. 4365-15.6", 1971-1973, USA.
Johns Manville, Glass Fiber Mats, Elasti-Glass® 3200B Series, 1 p., Oct. 30, 2002.
Johns-Manville Manufacturing Specification—Product- "Micro-Aire Duct Board Standard Duty Heavy Duty" Spec No. 4365-20, Oct. 7, 1971, USA.
Knauf, Air Duct Board-M with Hydroshield™ Technology, Submittal Sheet, Form No. AH-SS-6, Oct. 2000.
Knauf Fiber Glass Insulation—Products, www.knauffiberglass.com/index.cfm?fuseaction=prd.dspProdDetail&ID=12, pp. 1-7, visited Aug. 25, 2003.
Mid-rise and High-rise Exterior Building Envelope Board, Current System—Massachusetts "specifications".
North American Insulation Manufacturers Association, "Fabrication Dimensions for 2" (R-8.7) Fibrous Glass Duct Board, Pub. No. AH-136, Aug. 2002.
North American Insulation Manufacturers Association, "Facts About Using Sealants in Fiber Glass Air Handling Systems", Insulation Facts #36, Pub. No. AH 125, Sep. 2000.
North American Insulation Manufacturers Association, "Fibrous Glass Commercial Insulation Boards", Insulation Facts #67, www.naima.org, Jan. 2003.
North American Insulation Manufacturers Association, "Fibrous Glass Duct Construction Standards", 2nd Edition, 1993.
North American Insulation Manufacturers Association, "Fibrous Glass Duct System", Insulation Facts #64, Pub. No. AH 137, Jan. 2003.
North American Insulation Manufacturers Association, "Fibrous Glass Duct Wrap", Insulation Facts #66, www.naima.org, Jan. 2003.
RD Specialties, "Smooth Stainless Steel Rods, etc.", Webster, NY.
ROXUL®—The Better Insulation™—RHT™ 605 Commercial Board—Design No. W605, RHT Industrial Board, http://199.202.236.133/canada/product_details.asp?id=82, visited Aug. 21, 2003.
ROXUL®—The Better Insulation™—Technical Product Information, Board Insulation 15080 RHT™ 605, ROXUL, Inc., Jun. 1, 2002.
ROXUL®—The Better Insulation™—Technical Product Information, Board Insulation 15080, RHT™ 606, ROXUL, Inc., Jun. 1, 2002.
Underwriters Laboratories Inc., "Investigation of "Climaver 284," Air Duct Board", Dec. 19, 1991, Northbrook, Illinois, USA.
Underwriters Laboratories Inc., "Report on Air Ducts", Jun. 8, 1992, Northbrook, Illinois, USA.
International Search Report in PCT/FR2005/050611, dated Jan. 30, 2007.
Climaver 234 (1982).
Climaver 254 (1984).
Climaver 264 (1982).
Climaver 284-234 "Construction and self-support air conditioning ducts", 4 pages (translation attached) (1988).
Climaver Plata, Specification of a Product, Relevance on first page, density 70 kg/m$^3$ (not translated) (1992).
Elasti-Glass® R3100B Series Glass Fiber Mats, Schuller, 2 pages (May 1997).
Fiber-Glass Duct Systems, Aug. 14, 2003 http://www.tpub.com/steelworker2/27.htm, visited Aug. 14, 2003.
France-Air, "Glass Fibre panels for air ducts" (translation attached), 21 pages (1992).
Glasuld "Product Data-Industrial Sheet Black" Sheet: 172 p. 1, Nov. 1989, 1 page (translation of parts of the Danish ventilation attached).
Glasuld Ventilations-Kanaler.
Isover "Gama Climaver".
Isover Gullfiber—translation of the relevant parts of the Swedish Product Catalogue for Technical Insulation Mar. 1989.
Isover "Price List" Jan. 1991, (translation attached).
Isover Saint-Gobain Roche & Verre-Insulation and Air Conditioning, Mar. 1990, 3 pages (translation attached).
Johns-Manville, "Air Handling Systems—Linacoustic RC™ Fiber Glass-Duct Liner, with Reinforced Coating System," Preliminary Product Information), AHS-329—Feb. 2002.
Johns-Manville, "Air Handling Systems—Super Duct™ Coated High Performance Air Duct Board," Type 475 & 800, AHS 200 Jun. 2000, U.S. Paent Nos. 5,379,806 and 5,487,412.
Johns-Manville, "Type PM 10/3 Microlith®—Glass Fiber Non-woven", Nov. 2003.
Johns-Manville, "Type PM 10/4 Microlith®—Glass Fiber Non-woven", Dec. 2003.
Johns-Manville Manufacturing Specification—Product—"Micro-Aire Duct Board Standard Duty Heavy Duty" Spec No. 4365-20, Oct. 7, 1971, USA.
Knauf Air Duct Board, Form No. AH-SS-2 Effective: Jan. 1998, 2 pages.
Knauf Fiber Glass Insulation—Products, Knauf Air Duct Board-M www.Knauffiberglass.com/index.cfm?fuseaction=prd.dspProd-Detail&ID=14, pp. 1-7, visited Jan. 8, 2003.
Lydall, 23# Manniglas® 1803 WHB, Development Grade—Lot F2956, Data Sheet, 1 page, Nov. 20, 2002.
Lydall, 27# Manniglas® 1807, Development Grade—Lab Handsheets, Data Sheet, 1 page, Jan. 8, 2004.
Lydall, 40# Manniglas® 1786 Black, Development Grade—Lot F2933, Data Sheet, 1 page, Nov. 2002.
Lydall, 40# Manniglas® 1886 Black, Data Sheet, 1 page, Aug. 2002.
Lydall, 40# Manniglas® 1886 BX Black, Developmental Lot F2434, Data Sheet, 1 page, Dec. 2001.
Owens Corning, "Submittal Sheet—Aeromat® Duct Liner", May 2001, USA.
Owens Corning, "Submittal Sheet—EnDura Coat Duct Board", May 2001, USA.
Precision Coating Rods and Laboratory Products, Industry Tech, Oldsmar, FL.
Testing Data from the Competitive Audit on Mar. 25, 1999, 3 pages.
Ultra Additives Catalog, DEE FO/AGITAN defoamers, reprinted Jan. 21, 2003 from http://www.ultraadditives.com.
Underwriters Laboratories Inc.®, "Gas and Oil Equipment 1993".
Underwriters Laboratories Inc.,® "Gas and Oil Equipment 1994".
Underwriters Laboratories Inc.,® "Gas and Oil Equipment 1995".
Weiss, Herbert L., Coating and Laminating, Converting Technology Company, Milwaukee, Wisconsin, pp. 7-9, 196-202 (1997).
"Wire Wound Rod," Lembo-ITTI, http://www.lembo-itti.com/fx170005.htm Oct. 20, 1998.

* cited by examiner

| | | Tyvek Home Wrap | Tyvek Commercial Wrap | Sto Gold Coat | Forti-fiber Jumbo Tex | Fortif-iber Jumbo HD 30 Minute | Forti-fiber Super Jumbo Tex 60 Minute | Typar HouseWrap | Firstline First-Wrap Weather Barrier | Raven Indus-tries Rufco-Wrap | Pactiv Building Products RainDrop Housewrap | Pactive Building Products Classic Housewrap |
|---|---|---|---|---|---|---|---|---|---|---|---|---|
| Water Vapor Transmission | | | | | | | | | | | | |
| | ASTM E96 Method A (Perms) | 58 | 23 | 9.8 | 29 | 25 | 11 | 13.7 | 17.8 | 6.5 | 10 | 15 |
| | | | | | | | | | | | | |
| Water Penetration Resistance | | | | | | | | | | | | |
| | AATCC-127 | 210 cm | 280 cm | 55 cm | | | | 165 cm | 310 cm | | | |
| | ASTM D-779 | | | | 20 Mins | 30 Mins | 60 Mins | | | | > 60 mins | > 60 mins |
| | TAPPI T433 | | | | | | | | | | | |
| | | | | | | | | | | | | |
| Air Leakage Rate/Air Resistance | | | | | | | | | | | | |
| | ASTM E283 (cfm/ft$^2$ @75Pa/25 mph) | 0.007 | 0.001 | | | | | | | | | 0.03 |
| | TAPPI T-460 Gurley Hill Porosity (seconds/100cc) | 300 | >1500 | | | | | >2500 | 332 | | | |
| | CCMC Technical Guide MF-07273 L/(S.M) @ 75 Pa | | | | | | | 0.0023 | | | | |
| | Air Leakage (CFM/ft$^2$) when applied to a concrete block wall and tested @ 10.5 psf air pressure | | | | | | | | | | | |
| | | | | | | | | | | | | |
| Tensile Strength | | | | | | | | | | | | |
| | ASTM D2370 (psi) | | | 39 | | | | | | | | |
| | ASTM D828 MD (lb/in) | | | | 70 | 68 | 70 | 29 | | 27 | | |
| | ASTM D828 CD (lb/in) | | | | 29 | 31 | 60 | 26 | | 24 | | |
| | | | | | | | | | | | | |
| | ASTM D882 Method A (lbs/in MD/CD) | 30/30 | 38/35 | | | | | | 33/30.5 | | 56/30 | 51/38 |
| | | | | | | | | | | | | |
| Surface Burning Characteristics (Facing only) | | | | | | | | | | | | |
| | ASTM E84 Flame Spread | 5 | 10 | | | | | | 10 | 5 | 0 | 0 |
| | ASTM E84 Smoke Developed | 20 | 10 | | | | | | 30 | 15 | 15 | 30 |

FIG. 7

| Stamisol FA | ProtectoWrap Energy Housewrap | ProtectoWrap Dri-Shield Housewrap | Henry Air-Bloc 33 | Henry Air-Bloc 31 | Henry Air-Bloc 07 |
|---|---|---|---|---|---|
| | | | | | |
| 38.3 | 6.5 | 7.5 | 11.6 | 12.3 | 4 |
| | | | | | |
| | | | | | |
| | | | | | |
| | | > 110 mins | | | |
| | Exceeds 10 minute requirement | | | | |
| | | | | | |
| | | | | | |
| | | | | | |
| | | 9.4 | | | |
| | | | 0.001 | | |
| | | | | 0.0002 | 0.0052 |
| | | | | | |
| | | | | | |
| | | | | | |
| | | | | | |
| | | | | | |
| | | | | | |
| | 27/24 | 50/46 | | | |
| | | | | | |
| | | | | | |
| | 5 | 14 | | | |
| | 15 | 1 | | | |

((Continuation of FIG. 7)

INSULATION BOARD WITH AIR/RAIN BARRIER COVERING AND WATER-REPELLENT COVERING

This application is a division of U.S. patent application Ser. No. 10/898,740, filed Jul. 26, 2004, which is expressly incorporated by reference herein in its entirety.

FIELD OF THE INVENTION

The invention relates generally to the field of building material products and, in particular, to insulation products for building exterior walls.

BACKGROUND

In building construction, the primary barrier between the interior environment and the unstable exterior environment is provided by multiple layers of a variety of materials.

Although combinations of materials have been developed capable of providing thermal insulation and a moisture barrier, these capabilities are undermined when there are holes or discontinuities in the barrier material. These holes and discontinuities result in excessive heat loss (or heat infiltration into air-conditioned structures) through air infiltration. The air that infiltrates the barrier carries moisture that is retained, causing mold growth and damage or impaired durability.

One of the primary tools to address these problems is the use of house wraps and other air barriers and vapor retarders.

Although house wraps have decreased the amount of moisture entering the interior of buildings, the associated air tightness of the barriers has resulted in a reduction in the drying ability of the barrier materials.

Further the performance of the barrier materials continues to depend on the quality of workmanship for installing the materials. If there are gaps or discontinuities between adjacent sections of house wrap, then infiltration can occur.

Recently, gypsum sheathing has been used outdoors in exterior insulation or finishing systems, with insulation layers, (sometimes referred to as "Exterior Insulation and Finish Systems (EIFS)"). These systems are designed to accept polystyrene insulation adhered to a glass-faced gypsum board, followed by a thin application of stucco, for example. Because of the exposure to the elements, gypsum sheathing boards are often treated or impregnated with hydrophobic additives.

U.S. Pat. No. 5,644,880, incorporated by reference herein, describes an EIFS, for which the essential components comprise a fibrous mat-faced, water-resistant gypsum board and an overlying finishing material. The finishing material can be in multi-ply or mono-ply form. It can be positioned contiguously to said gypsum board or it can directly overlie or be directly affixed to a member(s) which is sandwiched between said gypsum board and said finishing material.

Improved building products are desired.

SUMMARY OF THE INVENTION

In some embodiments, a method includes: providing a previously formed unitary building exterior envelope product comprising: a mineral fiber insulation board which comprises a binder having a hydrophobic agent and is resistant to liquid water-penetration and has first and second major surfaces, an exterior facing material, which resists air infiltration and liquid water penetration, laminated to the first major surface of the insulation board, the exterior facing material being permeable to water vapor, and a continuous interior facing laminated to the second major surface of the insulation board with an adhesive, so that the second major surface with the interior facing and adhesive thereon is resistant to liquid water-penetration and is permeable to water vapor. The section of unitary building exterior envelope product is mounted to an exterior side of a plurality of framing members of an exterior wall of a building, so that the interior facing faces the framing members. An exterior layer is mounted to the framing members using a connection device that passes through the section of building envelope product, with the facing material facing the exterior layer, thereby to form the exterior wall.

In some embodiments, a method includes providing a previously formed unitary building exterior envelope product which comprises a mineral fiber insulation board, a binder having a hydrophobic agent and is resistant to liquid water-penetration and has first and second major surfaces, an exterior facing material, which resists air infiltration and liquid water penetration, laminated to the first major surface of the insulation board, the exterior facing material being permeable to water vapor, and a continuous interior facing laminated to the second major surface of the insulation board with an adhesive, so that the second major surface with the interior facing and adhesive thereon is resistant to liquid water-penetration and is permeable to water vapor, wherein the exterior facing material includes a sealing tab, and wherein a double-sided tape is adhered to an inside surface of said sealing tab. The section of unitary building exterior envelope product is mounted to an exterior side of a plurality of framing members of an exterior wall of a building, so that the interior facing faces the framing members. An exterior layer from the group consisting of concrete masonry, ceramic tiles, glass, treated wood panel, siding, shingles, bricks, stucco or stone, is mounted to the framing members using a connection device that passes through the section of building envelope product, with the facing material facing the exterior layer, thereby to form the exterior wall.

BRIEF DESCRIPTION OF THE DRAWINGS

FIG. 7 is a table of material properties for the exterior facing shown in FIG. 2.

DETAILED DESCRIPTION

Figure 1:
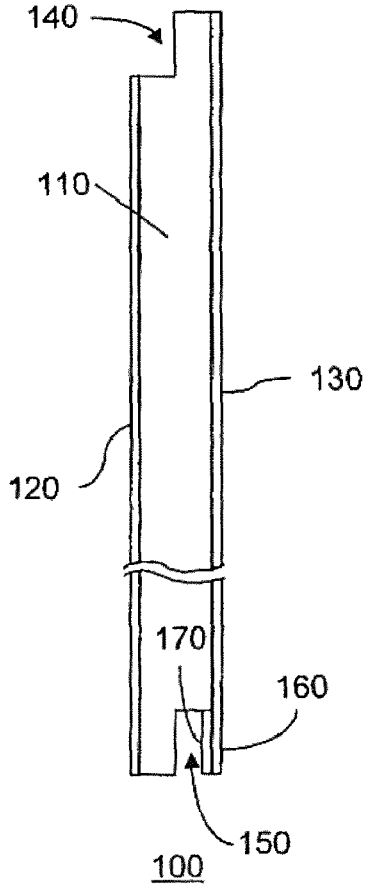
FIG. 1 is a side elevation view showing an exemplary mineral fiber insulation board resistant to penetration by liquid water according to one embodiment.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

U.S. application Ser. No. 10/322,433, filed Dec. 19, 2002 and U.S. application Ser. No. 10/322,433, filed Dec. 19, 2002, are incorporated by reference herein in their entireties.

Referring to FIG. 1, an insulation product 100 is shown comprising a mineral fiber insulation board 110 resistant to penetration by liquid water, having first and second major surfaces. Product 100 is also referred to herein as a building envelope panel 100 or exterior board system 100.

A facing material 130 capable of providing an air and rain barrier is laminated to the first surface of the insulation board. The facing material 130 is permeable to water vapor. A water repellent facing 120 is laminated to the second surface of the insulation board to form a unitary building exterior envelope product 100.

Preferred embodiments of the Exterior Board System (EBS) 100 perform the following functions in accordance with the general capabilities of a building envelope:

(1) Resist Water/Rain Penetration—The EBS preferably allows the building to be weatherized so that work on the interior components of the building can begin quickly, saving both construction time and cost.

(2) Handle Imposed Moisture Loads—The EBS should handle imposed moisture loads without degradation to itself or other building components. The EBS should allow moisture to escape to the exterior.

(3) Provide Thermal Insulation—The EBS will provide both immediate thermal insulation for the building as well as be a part of the final insulation package to meet energy codes.

(4) Act As An Air Infiltration Barrier—The EBS will minimize air leakage through it and will become part of the air infiltration barrier system.

The insulation product 100 is beneficially used as insulation in the exterior walls of buildings, such as steel stud commercial buildings. However, the insulation product 100 may be used in other building applications as well.

Insulation Board

The insulation board 110 is preferably a non-cementious board, such as a mineral fiber insulation board preferably comprises mineral fibers such as glass fibers, rock wool fibers, slag fibers, organic fibers, ceramic fibers (e.g., alumina), silica or basalt fibers resin bonded into a rigid or semi-rigid board. For example, suitable mineral fiber insulation boards are sold by Certain Teed Corp. of Valley Forge, Pa.

The mineral fiber insulation board 110 may have a density from about 2 pounds per cubic foot (PCF) to about 8 PCF. Preferably, the density of the insulation board 110 is from about 2.5 PCF to about 4.0 PCF, and more preferably, the density may be about 3 PCF. An exemplary board material is a fiber glass material having a binder content from about 6% to about 17%, preferably from about 14% to about 15%. A water repellant may be mixed with the binder or injected into the binder before the binder is sprayed on to the fiber glass. Exemplary water repellents may. be DC347, DC346, and DC 1581 from Dow Corning of Midland Mich. The water repellant may form a fraction of the total board content ranging from about 0.1% to about 2%. Some embodiments include about 0.2% water repellent. The water repellent may also be used to treat the facing 120 laminated to the board.

The hydrophobic agent is preferably introduced to the binder shortly before the spraying. The silicone may be added to the washwater used as dilution water shortly before spraying the fibers.

The silicone hydrophobic agent may also be applied to the mineral fibers separately from the binder in a water emulsion or solution that is used to cool the hot mineral fibers in a mineral fiber insulation fiberizing and forming section before the binder is applied.

Preferred insulation materials can be selected using two test methods in ASTM 473-00 Standard Test Methods for Physical Testing of Gypsum Panel Products for water resistance. The two test methods are:

1) Water Resistance of Core-Treated Water-Repellent Gypsum Panel Products, and

2) Surface Water Resistance of Gypsum Panel Products with Water-Repellent Surfaces.

In ASTM C473 Surface Water Resistance Cobb Test, preferred materials absorb about 40 grams or less of water in 10 minutes, preferably about 1.26 grams or less. In ASTM C 473 Core Water Resistance test, preferred materials absorb about 1050 grams or less of water per square foot in 120 minutes, preferably about 60 grams or less. The above core water resistance test values correspond to water absorption of less than about 400% of the insulation weight, preferably 74% or less. The surface water resistance test is performed on the insulation board surface 120.

In other embodiments, the insulation board 110 has a fibrous mineral matrix (e.g., fiber glass), into which are incorporated a phosphate-containing compound ("PCC," e.g., an inorganic phosphate salt) and a refractory mineral filler ("RMF," e.g., alumina or aluminum sulfate) to improve fire resistance. Preferably, the PCC is an inorganic phosphate salt. Suitable salts include monoammonium phosphate, diammonium phosphate, ammonium polyphosphate, monocalcium phosphate, dicalcium phosphate, aluminum phosphate, monosodium dihydrogen phosphate, tetrasodium pyrophosphate, sodium hexametaphosphate, sodium tripolyphosphate, tetrapotassium pyrophosphate, and potassium tripolyphosphate. Mixtures of multiple PCCs (e.g., mixtures of mono- and di-ammonium phosphates) can also be used. Hydrates of PCCs (e.g., monoammonium phosphate dihydrate) can be used, in which case water of hydration should not be considered in determining the content (e.g. % by weight) of the PCC in the insulation product. Although not critical, it is preferred that the RMF be relatively biologically inert, so that human contact with the flame resistant insulation product is not especially hazardous or irritating. Suitable RMFs include alumina, calcium oxide, magnesium oxide, titanium oxide, zirconia, and aluminum sulfate. Fiberglass insulation products comprising mono- and/or di-ammonium phosphate as a PCC and alumina or aluminum sulfate as the RMF have proven desirable. Hydrate forms of RMFs (e.g., aluminum sulfate hydrate) can be used, in which case water of hydration should not be considered in determining the content (e.g. % by weight) of the RMF in the insulation product. Additional details of a fire resistant insulation material are described in U.S. application Ser. No. 10/831,843, filed Apr. 26, 2004, which is incorporated by reference herein in its entirety.

Table 1 lists surface water penetration results (grams of water that penetrated through the surface tested) for several insulation board materials suitable for use in insulation board 110, based on a Cobb test from ASTM 473C. The tests indicated a potential for as low as 0.01 grams in ten minutes to a high of 250 grams in ten minutes.

In Tables 1 and 2, "OC" denotes Owens Corning of Toledo, Ohio, "Eco" denotes Ecophon of Naestved, Denmark, and "CT" denotes Certain Teed Corporation of Valley Forge, PA, "Han" denotes Hankuk Haniso Co. Ltd. of Chungchoengnam-do, Korea. MAG designates MAG Co. Ltd. of Ibaraki-Ken, Japan. Pactiv designates 2" thick Pactiv SLX extruded polystyrene Insulation board with film laminate on both sides as manufactured by Pactiv Building products of Atlanta, Ga. Dens Glass designates ⅝" thick Dens-Glass Gold Type X glass mat faced Gypsum Sheathing as manufactured by G-P Gypsum Corporation of Atlanta, Ga. OSB designates 7/16" Oriented Strand Board as manufactured by the Georgia Pacific company of Atlanta, Ga. Dow PU (foil faced foam) designates. 1" Tuff-R isocyanurate foam as manufactured by Dow Chemical Company of Midland, Mich. Gypsum Board designates ½" Paper faced gypsum board as manufactured by Georgia Pacific company of Atlanta, Ga.

Table 2 provides core water resistance for a 12"×12" sample in 2 hrs with a 1" head of water. Columns 1 and 2 provide the grams of water absorbed per square foot, and columns 3 and 4 provide the percentage of weight picked up. All facings and coatings were left intact, except as noted for Eco Hygiene Advance.

TABLE 2

| g H20/SqFt | | % H2O Pickup | |
|---|---|---|---|
| 2 | Pactiv Foam | 3 | OC Foam 1" |
| 2 | OC Foam 1" | 4 | OC Foam 2" |
| 4 | OC Foam 2" | 5 | Pactiv Foam |
| 5 | Dow PU Foam | 6 | Dow PU Foam |
| 28 | Eco. Hyg Advance | 7 | Dens-Glass |
| 44 | Eco. Gedina | 8 | OSB |
| 51 | Eco. Hyg Perform | 28 | Eco. Hyg Advance |
| 55 | OSB | 31 | Eco. Super G |
| 60 | MAG GWOS25 1" | 33 | Eco. Gedina |
| 82 | Dens-Glass | 34 | Eco. Hyg Perform |
| 98 | Eco. Super G | 47 | Gypsum Board |

TABLE 1

(Surface Water Resistance)

| Surface Water Resistance | g in 10 min | g in 2 hrs | Facing |
|---|---|---|---|
| OC Foam 2" | 0.01 | | |
| Pactiv Foam 2" | 0.01 | | |
| OC Foam 1" | 0.01 | | |
| Dow PU (polyisocyanurate) Foam | 0.02 | | Black thin polymer film on both sides |
| Eco. Gedina | 0.28 | 0.39 | Yellow Side tested - faced with transparent non woven material, most likely fiberglass; White Side - painted surface that creates a removable layer on top of the core. |
| Eco. Master A | 0.34 | 0.24 | Yellow Side tested - Same as Gedina |
| Eco. Hyg Advance | 0.39 | 0.35 | White Polymer Film Facing on both sides and edges removed, Glass nonwoven Faced side tested. |
| Eco. Super G | 0.41 | 0.38 | Yellow Side up -a light transparent non woven material, most likely fiberglass; White Side - a sheet comprised of weaved polymer strips (each about 0.5 mm wide). |
| Han #1 2" | 0.44 | — | |
| Eco. Hyg Perform | 0.55 | 0.37 | Yellow Side tested - same as Gedina |
| MAG GWOS25 1" | 1.3 | | Yellow unfaced side tested, white Tyvek facing on the other side |
| MAG 50L 2" | 1.4 | | |
| OSB | 1.6 | 5.98 | |
| Han #2 2" | 2.2 | — | |
| Dens-Glass | 7.3 | — | Yellow nonwoven fiber glass side tested, other side with White non woven fiber glass material on oother side, or any facing described in U.S. Pat. Nos. 5,718,785, 5,644,880, or 4,647,496. |
| Gypsum Board | 19.6 | 110.08 | |
| CT 2" UltraDuct Gold | Approximately 250 | — | White side - Johns Manville R8940 non-woven fiberglass layer, Opposite side - FSK facing. |
| CT 1.5" UltraDuct Gold | Approximately 250 | — | Same as CT 2" |
| CT 1" UltraDuct Gold | Approximately 250 | — | Same as CT 2" |
| Eco. Hyg Advance | 0.02 | 0.03 | With White Film Facing on both sides |
| Eco. Hyg Advance | — | 0.18 | Fiber Glass Board Only, All White Film and Glass Nonwoven Facings removed |
| CT ToughGard Rigid Liner Board 1" Thick | 0.08 | Approximately 200 | Black Nonwoven Faced Side |
| CT ToughGard Rigid Liner Board 1" Thick | Approximately 200 | — | Yellow, Unfaced Side |

TABLE 2-continued

| g H20/SqFt | | % H2O Pickup | |
|---|---|---|---|
| 188 | MAG 50L 2" Unfaced | 74 | MAG GWOS25 1" Faced |
| 188 | Eco. Master | 77 | Eco. Master |
| 359 | Gypsum Board | 128 | MAG 50L 2" Unfaced |
| 429 | Han #2 2" Unfaced | 245 | CT 1.5" UltraDuct Gold |
| 574 | CT 1.5" UltraDuct Gold | 257 | Han #2 2" Unfaced |
| 738 | CT 1" UltraDuct Gold | 301 | CT 2" UltraDuct Gold |
| 1053 | CT 2" UltraDuct Gold | 400 | CT 1" UltraDuct Gold |
| 1799 | Han #1 2" Unfaced | 584 | Han #1 2" Unfaced |

Based on the results of Table 1 and Table 2, the following products manufactured by Ecophon of Naestved, Denmark appeared to offer the best surface water resistance and core water resistance:

Ecophon Super G—TBPE—Product# 35591585
Ecophon Master A/Alpha—Product# 35441043
Ecophon Hygiene Performance A—Product# 35427307
Ecophon Gedina E T15—Product# 35419062
Ecophon Hygiene Advance—Product# 35137042

Exterior Facing

The exterior facing material 130 preferably comprises a polymer film (a film can be perforated to make it water vapor permeable), a coextruded polymer film, a polymer film laminate, a nonwoven mat, a coated non-woven or woven material, a polymer film/nonwoven laminate, a woven polymer film, a woven polymer laminated to a solid polymer film, a polymer film/woven glass laminate, a bituminous coated paper or film, a reflective film or foil. Any of the foregoing film materials can be perforated to permit the passage of water vapor. Alternatively, a spray applied liquid coating may be used. To select or qualify a material for the air barrier/rain screen 130, the AATCC-127-1998 Water Resistance: Hydrostatic Pressure Test may be used with a 100 cm minimum value to identify materials having a preferred water repellency.

The exterior facing 130 provides an air barrier that is resistant to penetration by liquid water, but is vapor permeable (i.e., not a vapor barrier), to permit moisture to escape from the building envelope 100.

Examples of suitable exterior facings include, but are not limited to: FirstWrap Weather Barrier, RoofTex 30B, PlyDry, or KraftTEX Building Paper by Firstline Corporation of Valdosta, Ga.; Fortifiber Jumbo Tex, Jumbo Tex HD 30 minute, Super Jumbo Tex 60 Minute, Two-Ply Jumbo Tex, Two-Ply Jumbo Tex HD 30 minute, or Two-Ply Super Jumbo Tex 60 minute from Fortifiber Corporation of Incline Village, Nev.; Tyvek, from DuPont of Wilmington Del.; Rufco-Wrap, from Raven Industries of Sioux Falls, S. Dak.; Typar house wrap from Reemay, Inc., of Old Hickory, Tenn.; Stamisol FA acrylic coated polyester non-woven facing, from Stamoid AG of Germany; or Protecto Wrap Energy Housewrap or Protector Wrap Dri-Shield Housewrap, from ProtectoWrap of Denver, Colo.

The adhesive used to laminate the air/rain barrier 130 to the fiber glass board 110 may be, for example, Henkel America Product No. 80-8273 hot melt adhesive and product number 50-0965MHV water base adhesive from Henkel of Avon, Ohio.

Alternatively, in place of the rain barrier facing 130, a coating such as "STO GOLD COAT"® Spray On air and liquid moisture barrier from Sto Corporation, Atlanta, Ga. may be applied on the exterior side of the panel 100. Other coatings that may be used are Air-Bloc 07, Air-Bloc 31, or Air-Bloc 33 spray applied products manufactured by the Henry Company, Huntington Park, Calif. The Henry "AIR BLOC™" coatings are vapor permeable air barrier systems, which provide continuous air tightness and water protection, while remaining permeable to the passage of vapor.

In some embodiments, the facing 130 provides air penetration between about 0.001 CFM/Ft$^2$ and about 0.007 CFM/ft$^2$ at 75 Pascals pressure. Based on the Gurley Hill TAPPI T-460 porosity test (ISO 5636-5), the facing may provide a porosity of between about 300 seconds/100 cc and about 2500 seconds/100 cc, or preferably between about 300 seconds/100 cc and about 1500 seconds/100 cc. In some embodiments, air leakage measured by an ASTM E283 test is about 0.017 ft$^3$/min.

FIG. 7 lists additional properties of several materials that may be used for exterior facing 130.

In addition to the facings described above, the exterior facing may be any of those described in U.S. Pat. Nos. 5,718,785, 5,644,880, or 4,647,496, which are incorporated by reference herein in their entireties.

Interior Facing

The interior facing 120 may be, for example, a non-woven material, a glass and/or a polymer fabric. The facing 120 may optionally be water repellant.

The nonwoven or woven facing 120 can be white or black. An example of a preferred white material for the non-woven mat facing 120 is "Dura-Glass®" R8940 wet laid glass nonwoven mat, manufactured by Johns Manville of Denver, Colo. The exemplary non-woven mat facing 120 has a thickness of about 0.023 centimeter (0.009 inch) and has a mass per unit area of about 38.7 grams/meter$^2$. Another example is a wet laid fiber glass and polyester fiber non-woven mat with a latex binder and having a thickness of, for example, 0.03 centimeter (0.012 inch), and a weight/square of 70 grams/m$^2$.

An exemplary water repellent glass nonwoven may be #1807 nonwoven from Lydall, Inc. of Manchester, Conn., weighing about 0.8 pounds per 100 square feet. Other suitable nonwovens may weigh up to about 2 pounds per 100 sq. ft.

Other exemplary facings may include 40# Manniglass 1886 Black mat or 1786 Black mat from Lydall Inc. of Green Island, N.Y. or water repellant Elasti-Glass® 3220B mat from Johns Manville of Denver, Colo. In other embodiments, the facing 120 is formed from filament glass fibers in an acrylic-based binder, such as Johns Manville Dura-Glass® 8440 with a water repellant (e.g., silicone or fluorocarbon) applied thereto. Other mat materials providing similar or better degrees of water repellency may alternatively be used. For example, such materials may include non-woven mats of glass fibers randomly dispersed into a web in a wet-laid process, bound in an acrylic or other resin system, and post treated with a fluorocarbon based coating that provides the desired degree of water repellency.

In one embodiment, the facing 120 comprises a nonwoven fiber glass mat having weight of less than 1.0 lb/100 ft$^2$ (53.7 g/m$^2$), and more preferably less than 1.0 lb/100 ft$^2$ (48.81 g/m$^2$). In one exemplary embodiment, the nonwoven fiber glass mat is the 27# Manniglas® 1807 mat having a target weight of 0.87 lb/100 ft$^2$ (42.3 g/m$^2$) and maximum weight of 0.97 lb/100 ft$^2$ (47.5 g/m$^2$) available from Lydall Inc., the 23# Manniglas® 1803WHB mat having a target weight of 0.80 lb/100 ft$^2$ (39.1 g/m$^2$) and a maximum weight of 0.90 lb/100 ft$^2$ (43.9 g/m$^2$) also available from Lydall Inc. or a mat having a weight therebetween. These exemplary nonwovens include an integral water repellent. In an exemplary embodiment, the nonwoven is combined, such as by saturation, with a water repellent comprising a fluorinated polymer, such as an fluorinated acrylic, fluropolymer or fluorocarbon, silicone, wax, oil, wax-asphalt emulsions, acrylics, other emulsions, latexes, polyvinyl acetates, etc. The weights reflect the combined weight of the coating and mat. In this embodiment, the desired water repellency can be achieved without the use of a water repellent added to the binder of the insulation board or adhesive used to adhere the nonwoven to the duct board.

Alternatively, interior facing 120 may be a woven fabric. Exemplary woven glass fabrics may be a square pattern with 10×10 yarns per inch such as PermaGlas-Mesh Resin Coated Fiber Glass Fabric 10×10, or PermaGlas-Mesh Resin Coated Woven Glass Fabric 20×20, manufactured by Saint-Gobain Technical Fabrics of St. Catharines, Ontario, Canada. Both fabrics have a tensile strength of 85 pounds per inch width in the machine direction (MD) and cross direction (CD). Alternatively, Childers CHIL-GLAS #10 Glass Fiber Reinforcing Mesh or Carolina Narrow Fabric woven glass may be used.

Needled, woven, knitted and composite materials may also be used, because of their impressive strength-to-weight ratio. The interior facing 120 can contain fibers and filaments of organic and inorganic materials. Examples include fibers containing glass, olefin (such as polyethylene, polystyrene and polypropylene), Kevlar®, graphite, rayon, polyester, carbon, ceramic fibers, or combinations thereof, such as glass-polyester blends or Twintex® glass-olefin composite, available from St. Gobain Corporation, France. Of these types of fibers and filaments, glass compositions are desirable for their fire resistance, low cost and high mechanical strength properties. The four main glasses used are high alkali (A-glass or AR-glass) useful in motor or cement applications, such as in tile backing, electrical grade (E-glass), a modified E-glass that is chemically resistant (ECR-glass), and high strength (S-glass).

The resistance (to liquid water) of the interior surface may come from the lamination process of a non liquid water resistant fabric laminated to a water resistant mineral fiber board with an adhesive having a hydrophobic additive. The resultant laminated board surface is resistant to liquid water even though the fabric itself may or may not be liquid water resistant. For example, if a fabric 120 having a loose, open weave (e.g., 10×10) is used, the spaces between the fibers of the fabric 120 are open, and the resistance to water penetration of the insulation surface with the adhesive and fabric thereon would be provided by the resistance of the insulation and/or the resistance of the adhesive to penetration by liquid water.

Combinations of fiberglass mat, scrim, chopped fibers and woven or knit filaments or roving can also be used for the interior facing layer 120. The appropriate weights of fiberglass mat (usually chopped-strand mat) and woven roving filaments or loose chopped fibers are either bound together with a chemical binder or mechanically knit, needled felted or stitched together. One suitable combination would be a fiberglass and/or resin fiber mat or scrim layered with chopped glass or resin fibers and then needled, felted or stitched together to decrease porosity.

In some embodiments, the interior facing 120 may optionally be a vapor retarder of a variable type (such as the "MEMBRAIN™" smart vapor retarder, sold by Certain Teed Corp. of Valley Forge, Pa.). A smart vapor retarder changes its permeability with the ambient humidity condition.

Table 3 lists several preferred vapor retarder—facing combinations for the interior surface 120, for embodiments with an ASTM E84 "Standard Test Method for Surface Burning Characteristics of Building Materials,": maximum 25/50 flame spread/smoke developed classification. In Table 3, VyTech indicates VyTech Industries, Incorporated, Anderson, S.C.; Lamtec indicates Lamtec Corp. of Flanders, N.J., Fuller indicates HB Fuller Co.

TABLE 3

| Mfg'r | Facing ID | Facing Type | Adhesive Mfg'r | Adhesive ID |
|---|---|---|---|---|
| Compac | MB2003 | PSK | Henkel | 50-0965 MHV |
| Compac | MB2001/VR900 | PSK | Fuller | V3484 |
| VyTech | Atlas 96 | Vinyl | Fuller | V3484 |
| Lamtec | WMP10 | PSK | Fuller | WB1961 |
| Lamtec | WMP 30 | PSK | Henkel | 50-0965 MHV |
| Lamtec | WMP 10 | PSK | Henkel | 50-0965 |

In addition to the facings described above, the interior facing may be any of those described in U.S. Pat. Nos. 5,718,785, 5,644,880, or 4,647,496, which are incorporated by reference herein.

Although it is preferred that the material of the interior facing be resistant to penetration by liquid water, other facings may be used. If the facing material is not liquid water penetration resistant, or it has openings that would permit penetration, then liquid water penetration resistance for the panel 100 may be provided by using a water penetration resistant insulation material 110 and/or water penetration resistant adhesive.

Edges

In some embodiments, the mineral fiber insulation board includes a male shiplap edge 150 and a female shiplap edge 140.

Figure 2:
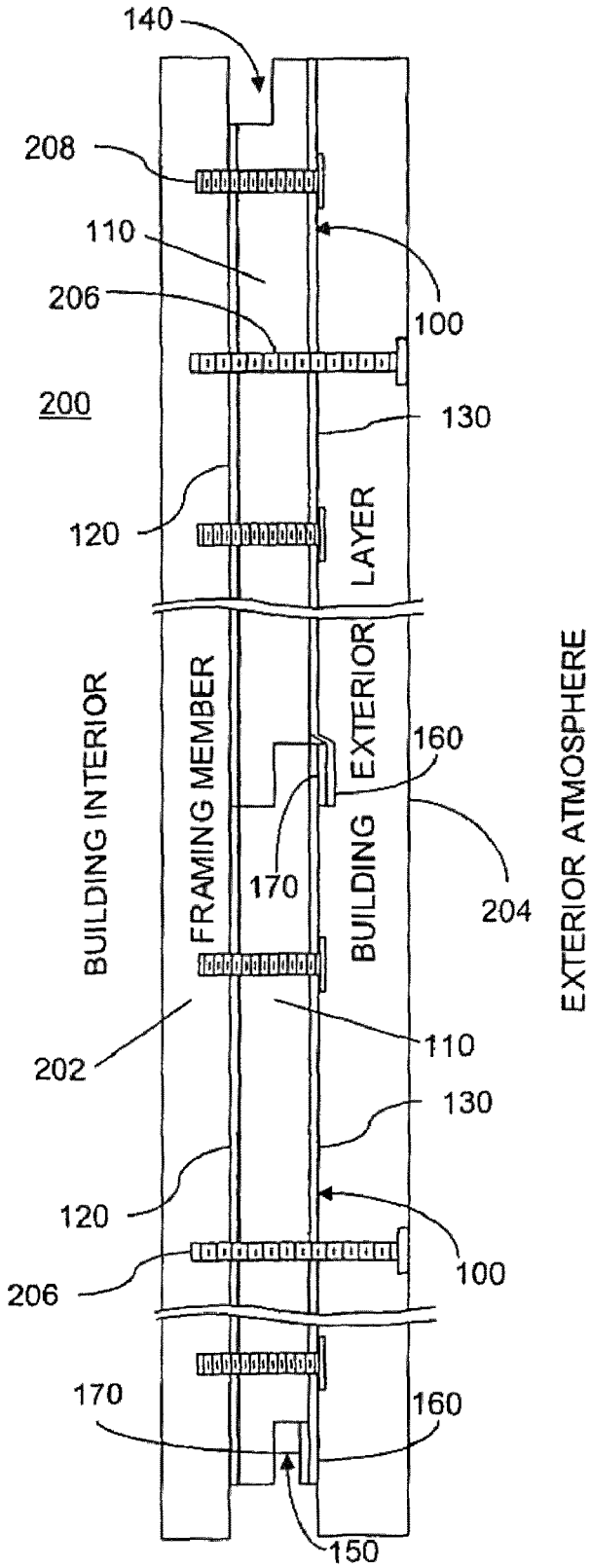
FIG. 2 is a side cross-sectional view showing an exterior wall including a pair of boards of the type shown in FIG. 1, mounted on a framing member of a building.

In some embodiments, the facing material 130 includes a sealing tab 160. The sealing tab 160 preferably extends to the end of the male shiplap edge 150 (and preferably, the facing 130 extends in the other direction to the end of the female shiplap edge 140). The sealing tab 160 overlies the mating female shiplap edge 140 of an adjacent section 100 of the building material, as best seen in FIG. 2. Thus, the sealing tab 160 ensures that the seam of facing 130 does not coincide with a gap between the mating male shiplap edge 150 and female shiplap edge 140.

In other embodiments (not shown), a sealing tab may extend beyond the end of the female shiplap edge 140.

Optionally, a double-sided tape 170 (or coating of pressure sensitive adhesive) may be adhered to an inside surface of the sealing tab 160. One of ordinary skill understands that the drawings are not to scale, and the thicknesses of the tab 160 and the tape 170 are exaggerated for clarity. Some suitable self sealing tapes—double sided tapes include, but are not limited to: Venture Tape 1163H NS and 1163/ms74 from Venture Tape of Rockland, Mass., and 3M 9500PC, 9490LE, 9690 from Minnesota Mining and Manufacturing Co. of St. Paul, Minn.

The exemplary product 100 can be incorporated in an exterior building wall 200, as shown in FIG. 2. FIG. 2 is a side cross sectional view of a portion of an exterior wall 200. It will be understood that the wall 200 can include any number of panels to extend upwards or downwards for any desired height, and leftwards and rightwards for any desired width; the depiction of two boards 100 in the wall 200 of FIG. 2 is an arbitrary sample for convenience of illustration only.

The wall 200 comprises a plurality of framing members 202. A layer of at least one panel 100 of a unitary building envelope material is mounted on an exterior side of the framing members 200. For example, FIG. 2 shows a plurality of fasteners 208 that attach the panels 100 to the framing members 202. In other embodiments, an "X-Seal™" Anchor sold by Hohmann and Barnard, Inc. of Hauppauge, N.Y. may be used (described below with reference to FIG. 8) in place of fasteners 206 and 208 to fasten the components shown in FIG. 2 (i.e., fasten the exterior layer 204 to the framing members 202). The insulation board 110 is not a load bearing product. The building envelope material 100 may be of the type described above with reference to FIG. 1, including: a mineral fiber insulation board 110 resistant to penetration by liquid water having interior and exterior major surfaces, a facing material 130 capable of providing an air and rain barrier laminated to the exterior surface of the insulation board (the facing material being permeable to water vapor), and a facing 120 resistant to penetration by liquid water, laminated with an adhesive having one or more hydrophobic additive(s) to the interior surface of the insulation board, with the interior surface facing the framing members.

An exterior layer 204 is provided on the exterior side of the building envelope material. The exterior layer 204 may be, for example, concrete masonry, ceramic tiles, glass, treated wood panel, siding, shingles, bricks, stucco or stone, or the like. The exterior layer 204 is connected to the framing members 202 using a connection device 206 that passes through the section 100 of building envelope product, with the facing material 130 facing the exterior layer 204. Although FIG. 2 shows bolts 206 as connection devices, a variety of fasteners and connection devices may be used. One of ordinary skill in the art understands that the preferred type of connection device for any given wall depends on the material of the framing members 202 and the material of the building exterior layer 204. The building envelope panel 100 does not support the structure, so the connection devices 206 merely pass through panels 100.

In one example, a stone facade 204 is tied to the steel stud structure 202 with a metal tie 206 that is screwed through the panel 100 into the steel framing 202.

FIG. 2 shows how the exemplary panel 100 can simplify installation and reduce labor. The panel 100 provides a single product that can replace two to four different building materials that were separately applied in the prior art. There is no need to separately install each of the following building materials: (1) a water repellant air infiltration barrier, (2) insulation (3) a water vapor permeable air/rain barrier, and (4) sealing tape. Although FIG. 2 shows the building exterior layer 204 in direct contact with the exterior facing 130, in other embodiments (not shown), there is an air gap between the exterior facing 130 and the building exterior layer 204.

As shown in FIG. 2, the mail shiplap edge 150 fits into the female shiplap edge 140, and the tab 160 on the bottom of the upper panel 100 overlaps the exterior side of the female shiplap edge 140. The double sided tape or adhesive 170 forms a seal between the two panels 100. Thus, the shiplap construction ensures that there is no continuous air gap between two adjacent panels.

Although the figures show a panel having male and female shiplap edges only on the bottom and top, respectively, of the panel 100, additional male and female shiplap edges (not shown) may be placed on the left and right sides of the panel. By providing shiplap edges on all four sides of the panel, adjacent panels can easily be joined and sealed on all four sides of a given panel, with improved sealing and reduced labor. In another embodiment (not shown) there are no shiplap edges, but the facing has a flap on one side only. In still another embodiment, the facing has flaps on two sides—one horizontal and one vertical.

Fire Resistant Panel

The interior surface (without any enhancement) has a maximum flame spread/smoke developed fire hazard classification of 25/50 when tested according to ASTM E84 test method. In some embodiments, the product can be provided with enhanced fire resistance.

Figure 3:
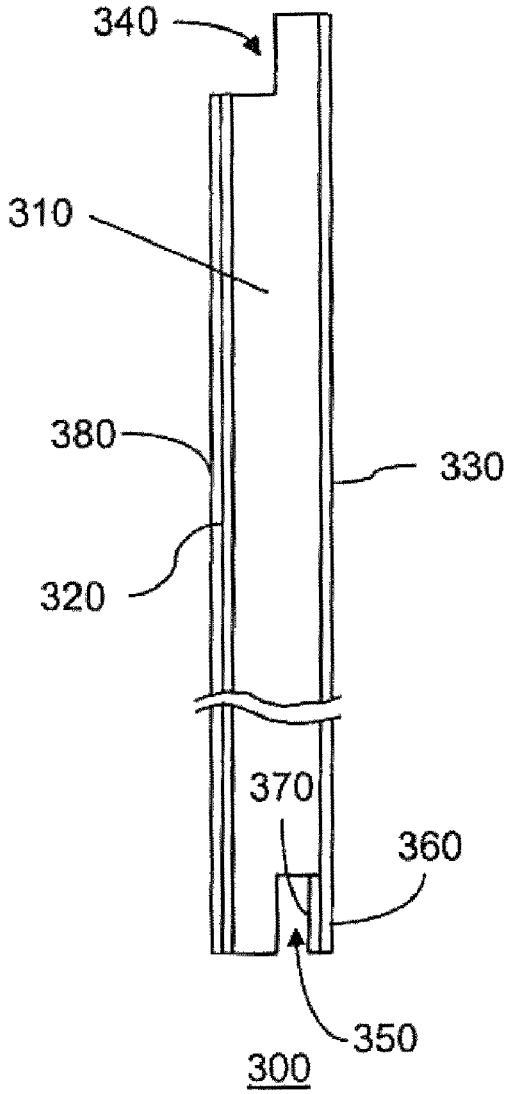
FIG. 3 is a side elevation view showing a variation of the exemplary mineral fiber insulation board of FIG. 1.

FIG. 3 shows another variation of the EBS panel 300. Items in FIG. 3 which are the same as shown and described above with reference to FIG. 1 have the same reference numerals, increased by 200. These include panel 300, insulation board 310, water repellent interior facing 320, exterior air and rain barrier facing 330, female shiplap edge 340, male shiplap edge 350, tab 360, and tape or adhesive 370. Descriptions of these items are not repeated. The panel 300 further comprises an enhanced fire resistive "face" 380, optionally provided on the side of the insulation 310 that faces the interior of the building. The fire resistance is provided by a coating or facing 380 applied to the insulation 310, over interior facing 320. In some embodiments, the enhanced fire resistant coating is applied directly to the insulation 310, with no facing layer 320 present. These materials or other fire resistant facings or membranes that achieve their fire resistance though intunescents and/or vermiculite may be used.

In another embodiment of a fireproofing method, a mixture comprising vermiculite and expandable graphite are dispersed in water, and the dispersion is coated onto the glass fiber substrate 310, and dried. Details of this method are described in U.S. application Ser. No. 10/322,433, filed Dec. 19, 2002, which is incorporated by reference herein.

Some specific examples of fire resistant facing materials 380 suitable for enhancing fire resistance include:

1) "VEXTRA"® vermiculite coated woven glass fabrics from Auburn Manufacturing Inc., Mechanic Falls, Me.;

2) "FYREROC"® inorganic coated fireproof materials from Goodrich Corporation, Engineered Polymer Products Division, Jacksonville, Fla. These products may include the following substrates coated with a fire resistant inorganic coating : carbon filament woven fabric, steel wool, a three layer laminate of nonwoven glass, woven steel fibers, and nonwoven glass.

3) "AD FIREFILM II"® Intumescent Coating from AD Fire Protection Systems, Scarborough, Ontario 4) "FIREFREE 88"® Intumescent Coating from International Fire Resistant Systems, Inc. San Rafael, 5) Albi Clad 800 Intumescent coating, from Albi Manufacturing Division of StanChem, Inc. East Berlin, Conn.

6) Passive Fire Barrier coating from Contego International of Carmel, Ind.,

7) Universal Fire Shield from Unishield, LLC of Denver, Colo.

Figure 4:
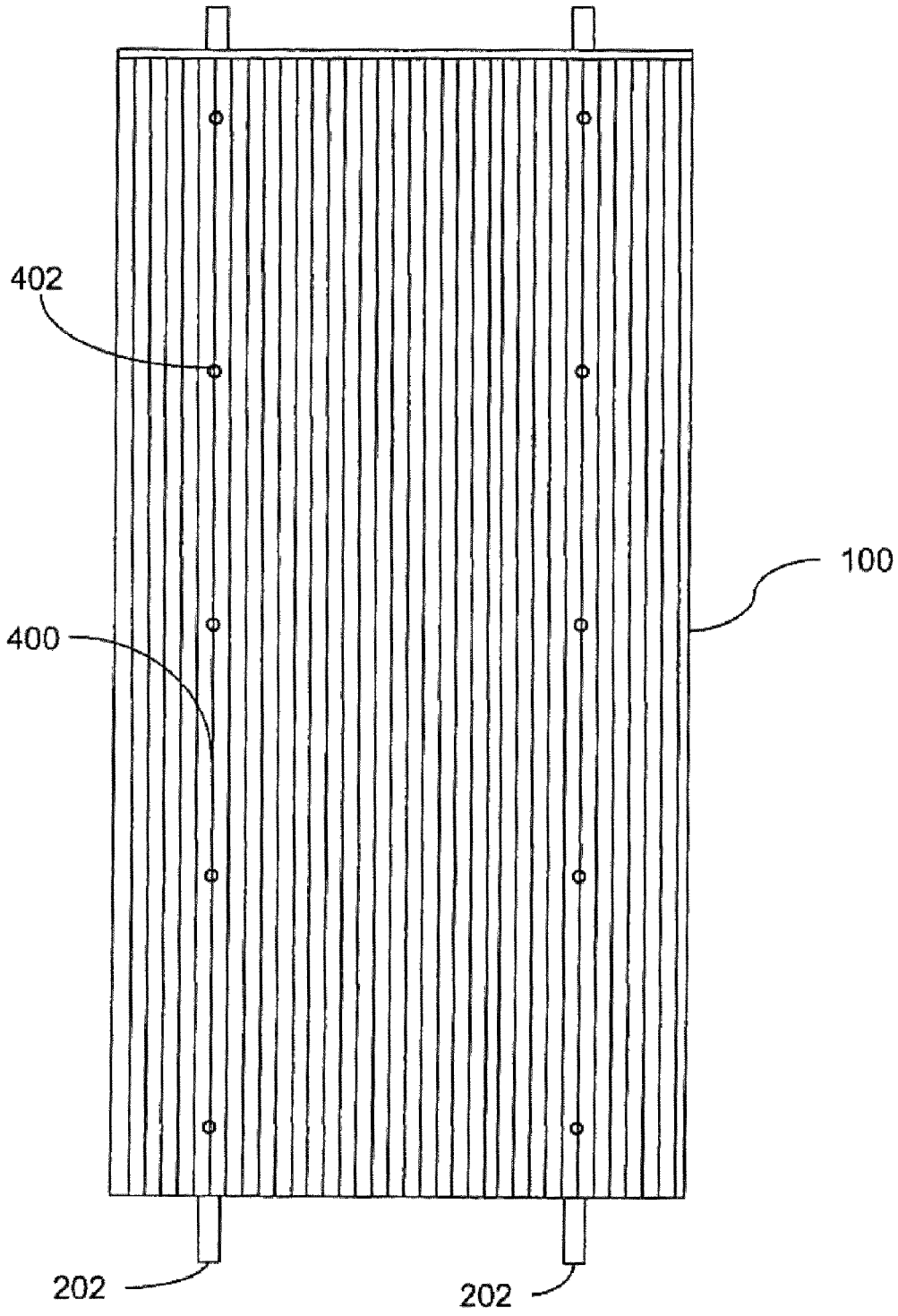
FIG. 4 is a front elevation view of a panel of FIG. 1 or FIG. 3, installed on framing members.

In some embodiments, the surface of the board 100 or 300 closest to the installer (typically the exterior layer 130) is printed with vertical lines 400 every inch (or other selected interval) to serve as guide marks for installing the board 100 or 300 on steel studs 202. All the screws (or other fasteners) 402 driven through the board 100 or 300 should go into a steel stud 202 under the board. Most of the steel stud 202 is hidden by the board 100, 300 (as shown in FIG. 4) when the installer places the board against the studs. However, the top of the stud 202 is visible, and the installer can see where the steel studs 202 lie relative to the vertical line pattern printed on the face of the board. For example, if the studs are at inch marks 4, 28, 52, 76; the installer can place his or her mounting screws 402 at those vertical lines 400 in the middle, top, and bottom of the board 100, 300. Also, when the boards are applied so that the lines are in a horizontal fashion, the lines serve as a spacing marker. This marker shows the position for separation of fasteners as required by the manufacturer or Architect (such as 12" on center, or every 12"). This will also ease the installation process, as an installer can count the lines once, begin installation and follow that same line throughout the installation.

Alternatively, these lines can be of different, but repeating colors (e.g., 6 or 12 distinct different colors that repeat in the same fashion). This would give the installer an easy-to-identify-and-follow line for the installation process (i.e.—If the installer begins on the red line, they know to follow the red line for the remainder of that line of fasteners).

Figure 5:
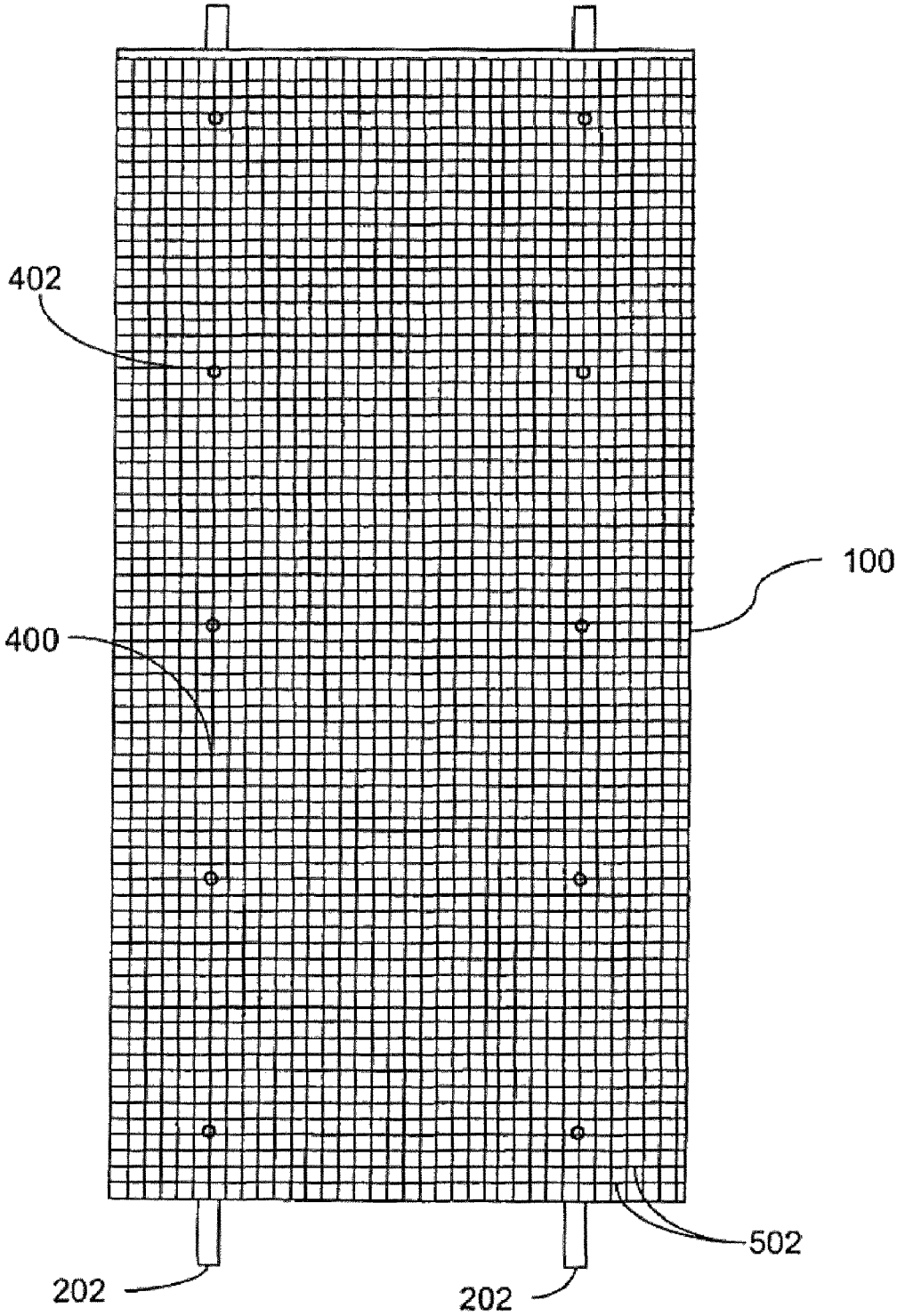
FIG. 5 is a front elevation view of a panel as shown in FIG. 1 mounted on framing members.

FIG. 5 shows another example in which both vertical lines 400 and horizontal lines 502 are provided in a grid pattern. Regardless of in which direction the panel is oriented, one set of lines will be parallel to the studs 202, and the other set of lines can be used for spacing the anchors (or other fasteners).

Figure 6:
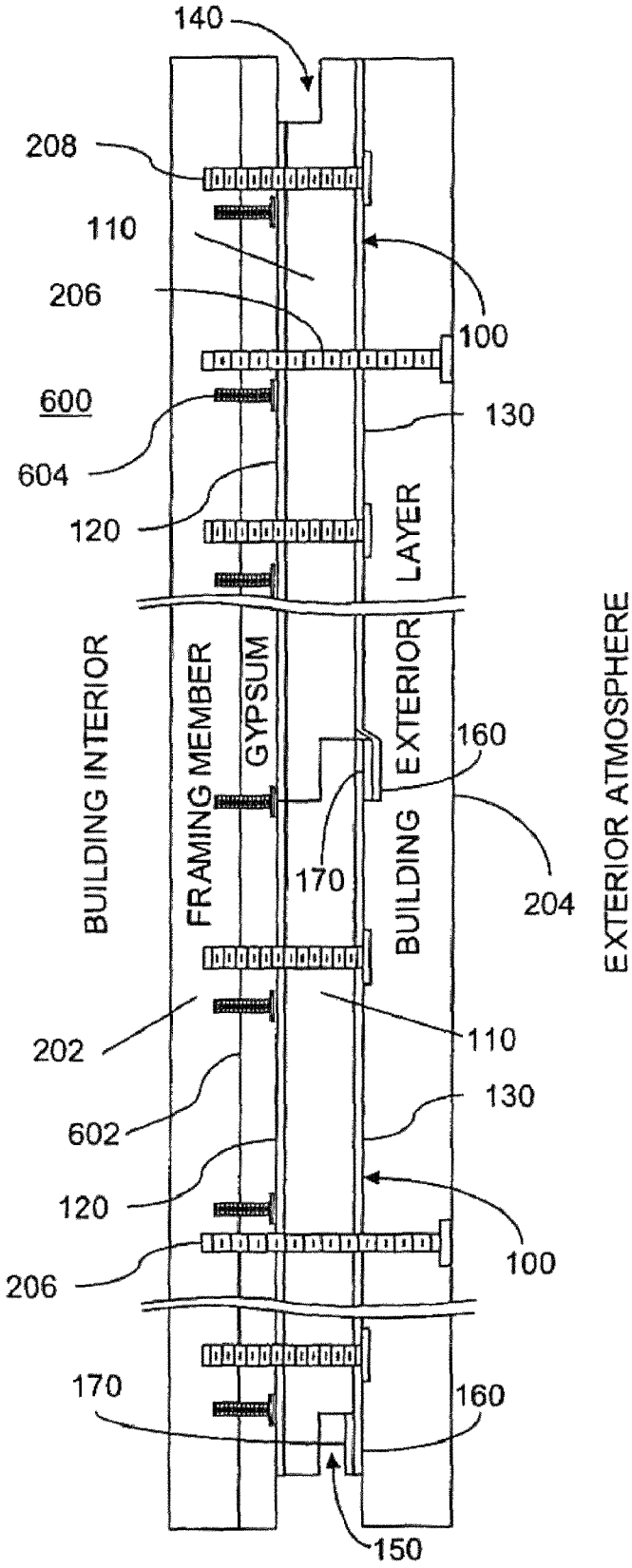
FIG. 6 is a side cross-sectional view of a variation of the wall of FIG. 2.

FIG. 6 shows another exterior wall 600, which is a variation of the wall 200 of FIG. 2. Like items are indicated by like reference numerals. Descriptions of the items which are described above with reference to FIG. 2 are not repeated. Wall 600 includes steel studs 202, a layer of exterior gypsum 602 held in place by fasteners 604, panel 100, wall anchors (or other fasteners 208), and exterior stone cladding (or other building exterior layer) 204.

In some embodiments, the interior facing 120 of FIG. 6 may optionally be a vapor retarder 120 of a variable type (such as the "MEMBRAIN®" smart vapor retarder, sold by Certain Teed Corp. of Valley Forge, Pa.). Thus, if excess moisture accumulates in the gypsum (gypsum is relatively water vapor permeable), the use of a smart vapor retarder for facing 120 would allow the moisture to escape to the exterior of the building.

In some embodiments, the fasteners 206 are not necessary, because the mounting system of panel 110 includes an attachment to the outer wall 204, e.g., ties for brick.

Figure 8:
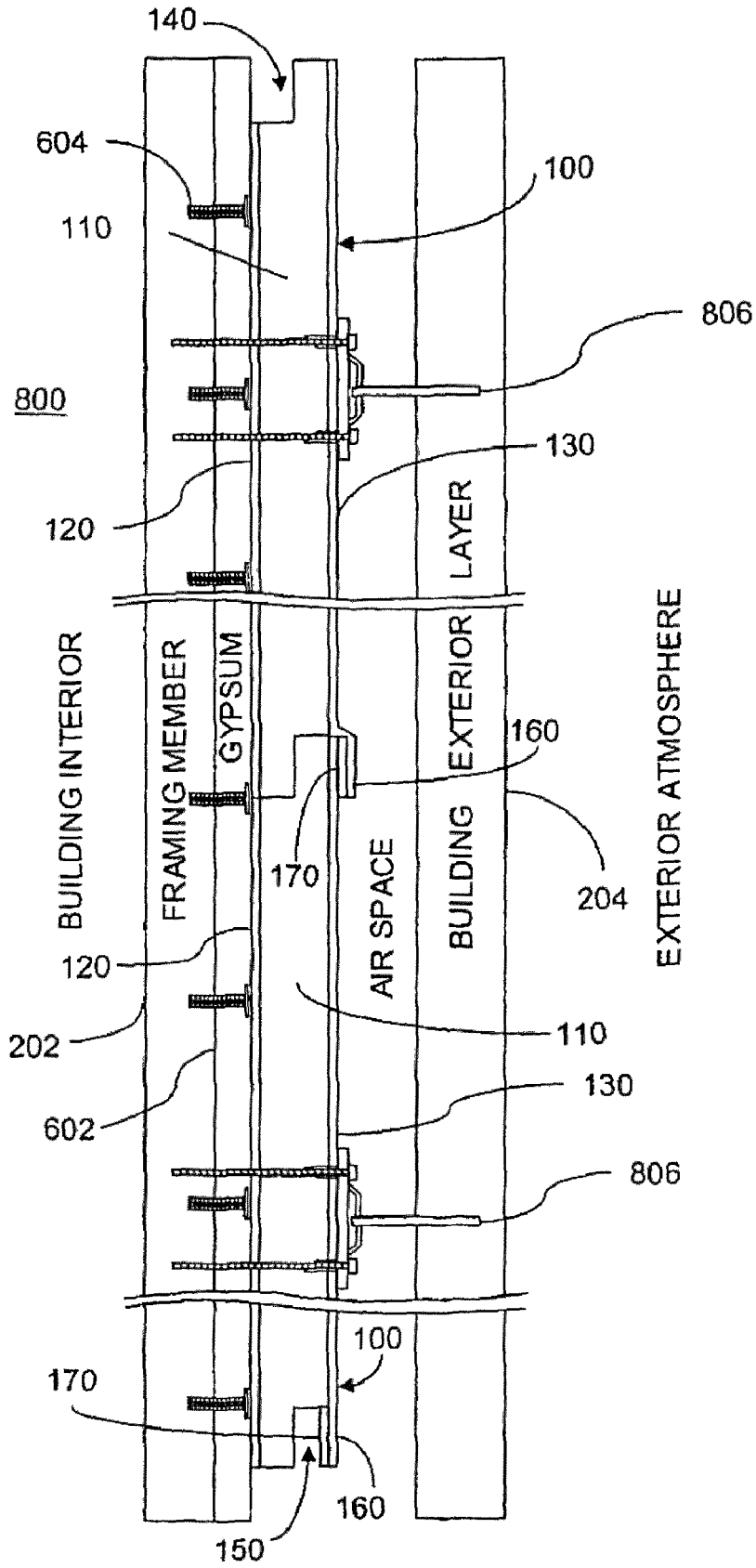
FIG. 8 is a side cross-sectional view of a another variation of the wall of FIG. 2.

FIG. 8 is a side cross sectional view of a wall 800, which is another variation of the wall of FIG. 2. In FIG. 8, an air space is provided between the panel 100 and the building exterior layer 204. The building exterior layer 204 can be "self supporting" in the vertical direction (e.g., brick) and may only need anchors 806 in the horizontal direction for tension and compression resistance. In one embodiment, the anchor 806 may be an "X-Seal™" Anchor sold by Hohmann and Barnard, Inc. of Hauppauge, N.Y. The "X-Seal™" Anchor is advantageously used for the insulation board 110, because it applies the load of the exterior wall to the steel stud 202.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method, comprising:

(a) providing a previously formed unitary building exterior envelope product comprising:

a mineral fiber insulation board which comprises a binder having a hydrophobic agent, said mineral fiber insulation board being water-repellant and having first and second major surfaces, an exterior facing material, which is an air and rain barrier, laminated to the first major surface of the insulation board, the exterior facing material being permeable to water vapor, and a water repellant interior facing laminated to the second major surface of the insulation board, and which is permeable to water vapor;

(b) mounting the unitary building exterior envelope product to an exterior side of a plurality of framing members of an exterior wall of a building, so that the interior facing faces the framing members; and (c) mounting an exterior layer to the framing members using a connection device that passes through the section of building envelope product, with the exterior facing material facing the exterior layer, thereby to form the exterior wall.

2. The method of claim 1, wherein the exterior layer is selected from the group consisting of concrete masonry, ceramic tiles, glass, treated wood panel, siding, shingles, bricks, stucco or stone.

3. The method of claim 1, wherein step (b) is performed so that the section of unitary building exterior envelope product directly contacts the framing members.

4. The method of claim 3, wherein step (c) is performed so that the exterior layer directly contacts the section of unitary building exterior envelope product or faces an air space next to the section of unitary building exterior envelope product.

5. The method of claim 1, wherein the exterior facing material of a first section of the unitary building exterior envelope product includes a sealing tab, the sealing tab being resistant to penetration by liquid water the method further comprising:

mounting a second section of the unitary building exterior envelope product to the exterior side of a plurality of framing members of an exterior wall, with the facing material facing the framing members; and attaching the sealing tab of the first section of the unitary building exterior envelope product to the second sections of unitary building exterior envelope product, to form a seal between the first and second sections of an adjacent unitary building exterior envelope product without applying a separate building wrap or sealing tape.

6. The method of claim 5, wherein the tab has a pressure sensitive adhesive or a double sided adhesive tape thereon.

7. The method of claim 5, wherein the mineral fiber insulation boards of the first and second sections each includes a male and female shiplap edge, the method further comprising joining the male edge of the first section to the female edge of the second section, or joining the male edge of the second section to the female edge of the first section.

8. The method of claim 1, wherein the exterior facing has a plurality of periodically spaced printed lines thereon, the method further comprising:

using the periodically spaced lines as guide marks for placement of fasteners to mount the unitary building exterior envelope product to a framing member.

9. The method of claim 8, wherein the periodically spaced printed lines have a plurality of different colors arranged in a repeating sequence, such that for each one of the different colors, the printed lines having that color defines a respective set of guide marks for placement of fasteners to be driven into studs, and an installer begins on a line of a first one of plurality of different colors and follows lines of the same color to place a remainder of a line of fasteners.

10. The method of claim 1, further comprising, before step (a):

laminating the exterior facing material to the first major surface of the insulation board; and bonding the interior facing to the second major surface of the insulation board with the adhesive.

11. The method of claim 10, wherein:

the mineral fiber insulation board comprises glass fibers;

the exterior facing material comprises one of the group consisting of a polymer film, a polymer film laminate, a nonwoven mat, a polymer film/nonwoven laminate, a woven polymer film, a polymer film/woven glass laminate, a bituminous coated paper or film, or a reflective film or foil that is perforated to permit the passage of water vapor; and the interior facing is a glass and/or polymer fabric.

12. The method of claim 10, wherein the exterior facing material has a reflective surface that reflects radiant energy.

13. The method of claim 1, wherein step (a) is performed by installing a single product without performing respective separate installation steps for installing each of: a water repellant air infiltration barrier, an insulation layer, and a water vapor permeable air/rain barrier, and wherein the exterior facing material includes a sealing tab for sealing the unitary building exterior envelope product without applying a separate sealing tape.

14. A method comprising:

providing a previously formed unitary building exterior envelope product which comprises a mineral fiber insulation board, a binder having a hydrophobic agent, said mineral fiber insulation board being water-repellant and having first and second major surfaces, an exterior facing material, which is an air and rain barrier, laminated to the first major surface of the insulation board, the exterior facing material being permeable to water vapor, and a water repellant interior facing laminated to the second major surface of the insulation board and permeable to water vapor, wherein the exterior facing material includes a sealing tab, and wherein a double-sided tape is adhered to an inside surface of said sealing tab;

mounting the unitary building exterior envelope product to an exterior side of a plurality of framing members of an exterior wall of a building, so that the interior facing faces the framing members; and mounting an exterior layer from the group consisting of concrete masonry, ceramic tiles, glass, treated wood panel, siding, shingles, bricks, stucco or stone, to the framing members using a connection device that passes through the section of building envelope product, with the facing material facing the exterior layer, thereby to form the exterior wall.

15. The method of claim 14, wherein the sealing tab is resistant to penetration by liquid water, the method further comprising:

(d) mounting a second section of the unitary building exterior envelope product to the exterior side of a plurality of framing members of an exterior wall, with the facing material facing the framing members; and (e) attaching the sealing tab of the first section of unitary building exterior envelope product to the second section of unitary building exterior envelope product, to form a seal between the first and second sections of unitary building exterior envelope product without applying a separate building wrap or sealing tape.

16. The method of claim 15, wherein steps (a) to (c) are performed without separately installing each of: a water repellant air infiltration barrier, an insulation layer, a water vapor permeable air/rain barrier, and a sealing tape.

17. The method of claim 15, wherein steps (a) to (e) are performed without separately installing each of a water repellant air infiltration barrier, an insulation layer, a water vapor permeable air/rain barrier, and a sealing tape.

* * * * *